United States Patent [19]

Baker et al.

[11] 3,994,239

[45] Nov. 30, 1976

[54] TANK CAR HEAD SHIELD ASSEMBLY

[75] Inventors: Forrest L. Baker; Joseph F. Niggemeier; Dallas W. Rollins, all of Saint Charles, Mo.

[73] Assignee: ACF Industries, Incorporated, New York, N.Y.

[22] Filed: Mar. 3, 1975

[21] Appl. No.: 555,001

[52] U.S. Cl. ..... 105/358

[51] Int. Cl.[2] ..... B61D 5/00

[58] Field of Search ..... 105/358, 360, 362, 421, 105/394; 293/60, 64; 213/220, 222

[56] References Cited

UNITED STATES PATENTS

| | | | |
|---|---|---|---|
| 1,177,403 | 3/1916 | Enloe | 293/60 |
| 1,386,938 | 8/1921 | Lavington | 293/60 X |
| 1,488,685 | 4/1924 | Kassler et al. | 105/358 |
| 1,915,770 | 6/1933 | Tessmer | 105/394 UX |
| 2,431,495 | 11/1947 | Mosser | 293/60 X |
| 3,605,634 | 9/1971 | Johnson | 105/421 X |

FOREIGN PATENTS OR APPLICATIONS

| | | | |
|---|---|---|---|
| 498,985 | 5/1930 | Germany | 105/362 |
| 1,186,895 | 6/1963 | Germany | 105/358 |

OTHER PUBLICATIONS

"Pressure–Type Tank Cars Studied for Puncture–Vulnerability Problems" *Railway Locomotives and Cars*, Dec. 1974–Jan. 1975, pp. 16, 17.

*Primary Examiner*—Robert J. Spar
*Assistant Examiner*—Randolph A. Reese
*Attorney, Agent, or Firm*—Henry W. Cummings

[57] ABSTRACT

A tank car head shield assembly is provided including a tank car head shield and structure for fastening the base of the head shield to the stub sill or center sill at the ends of the tank car. A pair of longitudinally extending supports connect the upper portion of the head shield on opposite sides of the car with portions of the tank car support structure located longitudinally inwardly from the tank head shield, for example, to the end sill, side sill, or to the bolster caps. The supports are connected to the head shield on the outboard side of the head shield. The supports may pass through openings in the head shield or the support members may be bent around the shield to the outboard side. A pair of supports or a single support having bends on either end of the shield may be used. The support(s) are attached to the shield by welding or mechanical fasteners. The support(s) are connected to the tank car support structure by a weldment, a clevis and/or a tube within a tube.

30 Claims, 16 Drawing Figures

TANK CAR HEAD SHIELD ASSEMBLY

BACKGROUND OF THE INVENTION

Recently the Department of Transportation has focused on the problem of transporting hazardous materials in railway tank cars. In the event of a derailment and/or in the event of a bypassed coupler, it is possible for the tank to burst and the hazardous material escape and harm persons or property in the area.

Specifically, in the event of a bypassed coupler the coupler of one car can move up and puncture the tank of the adjacent car, causing the hazardous material to escape.

In order to alleviate this problem, the Department of Transportation has established that all tank cars carrying hazardous materials (112A340W, 112A400W and 114A500W in the 112 and 114 classification) must be provided with head shields.

The tanks for railway tank cars are in the heat treated condition. A head shield cannot simply be welded onto a heat treated tank car. The welding operation results in a heat affected zone which may be brittle and thus has a greater chance of bursting under pressure and/or in transit, and further such a welded unannealed tank car does not meet the requirements of the ASME Pressure Vessel Code.

A lug is readily applied to a new tank car prior to heat treatment which can be of sufficient outward extent that the weld heat affected zone will not extend to the tank when the head shield is subsequently welded in place to the lug.

However, a problem exists as to how to apply head shields to new cars not having such welding lugs and how to retrofit tank cars now in the service of hazardous materials with head shields, none of which have such head shield welding lugs.

SUMMARY OF THE INVENTION

It is the object of the present invention to provide a support assembly for applying tank car head shields onto tank cars not having such a head shield welding lug.

It is another object of the present invention to provide such a tank car head shield support assembly which is economical to manufacture.

It is another object of the present invention to provide a head shield support assembly which is easily and inexpensively applied to existing cars.

A tank car head shield assembly is provided comprising a tank car head shield and structure for fastening the base of the head shield to the stub sill or center sill at the ends of the tank car. The structure for connecting the base of the head shield to the center or stub sill may include a weldment or mechanical fasteners. A pair of longitudinally extending supports connect the upper portion of the head shield on opposite sides of the car with portion of the tank car support structure located longitudinally inwardly from the tank head shield, for example, to the end sill or to the bolster caps. The supports are connected to the head shield on the outboard side of the head shield. The supports may pass through openings in the head shield or bent around the shield to the outboard side. A pair of supports or a single support having bends at opposite ends of the shield may be used. The supports may be integrally affixed to the head shield with various mechanical fastening arrangements or by welding. The support(s) may be connected to the tank car support structure by a weldment, a clevis and/or a tube within a tube.

THE DRAWINGS

SUMMARY OF THE INVENTION

A tank car head shield assembly is provided comprising a tank car head shield and means for fastening the head shield to the stub or center sill at the ends of the tank car. A pair of longitudinal supports connect the upper portion of the head shield on opposite sides of the car with portions of the tank car support structure longitudinally inwardly from the tank head shield, for example, to the end sill or to the bolster caps. The support members may comprise rods, straps, chains, cables, pipes or tubing. A single pipe or tubing may be also be used. Support connecting means connecting the support members to the tank car support structure may comprise a weldment, a clevis and/or a tube within a tube. Head shield connecting means connecting the support members to the head shield may comprise one or more of plates and a pin passing therethrough, a threaded end portion of the support means and a nut or support members integrally affixed by welding or mechanical fasteners preferably to the outboard side of the shield. The means for connecting the head shield to the center or stub still may comprise a weldment or mechanical fasteners.

DESCRIPTION OF PREFERRED EMBODIMENTS

Figure 1:
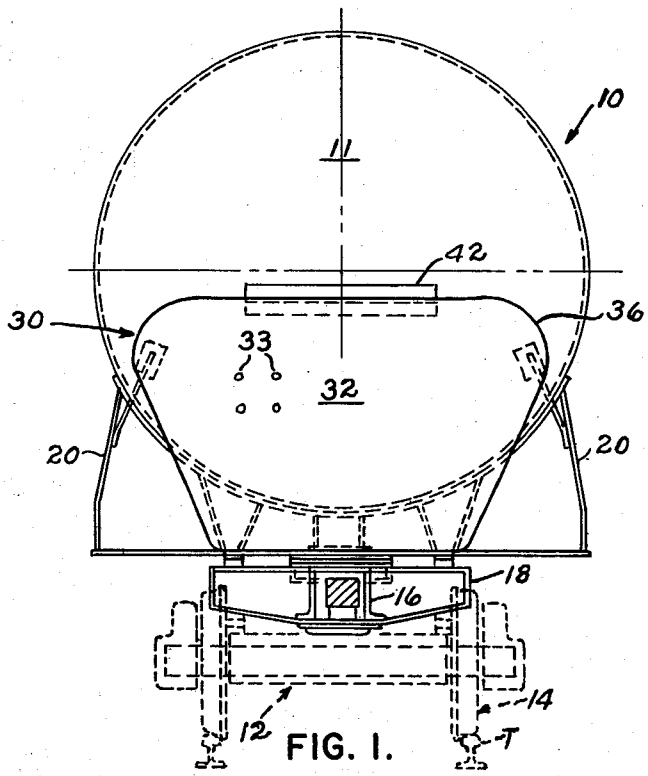
FIG. 1 is an end view of a railway tank car illustrating the support assembly of the present invention.
Figure 2A:
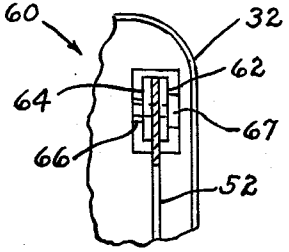
FIG. 2A is a detailed view along the lines 2A—2A in FIG. 2 illustrating the means for connecting the supports to the tank car head shield in accordance with the embodiment shown in FIGS. 1 and 2.
Figure 3:
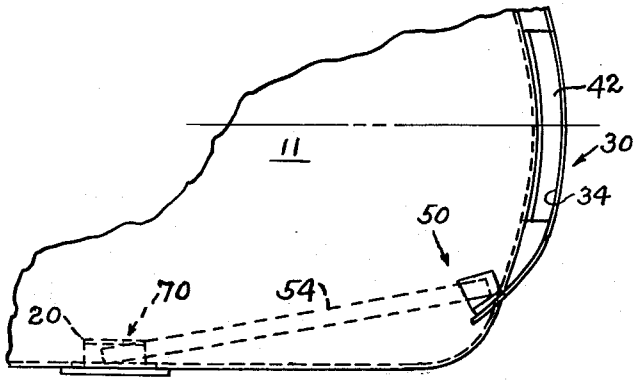
FIG. 3 is a plan view of the support arrangement shown in FIGS. 1 and 2.
Figure 2:
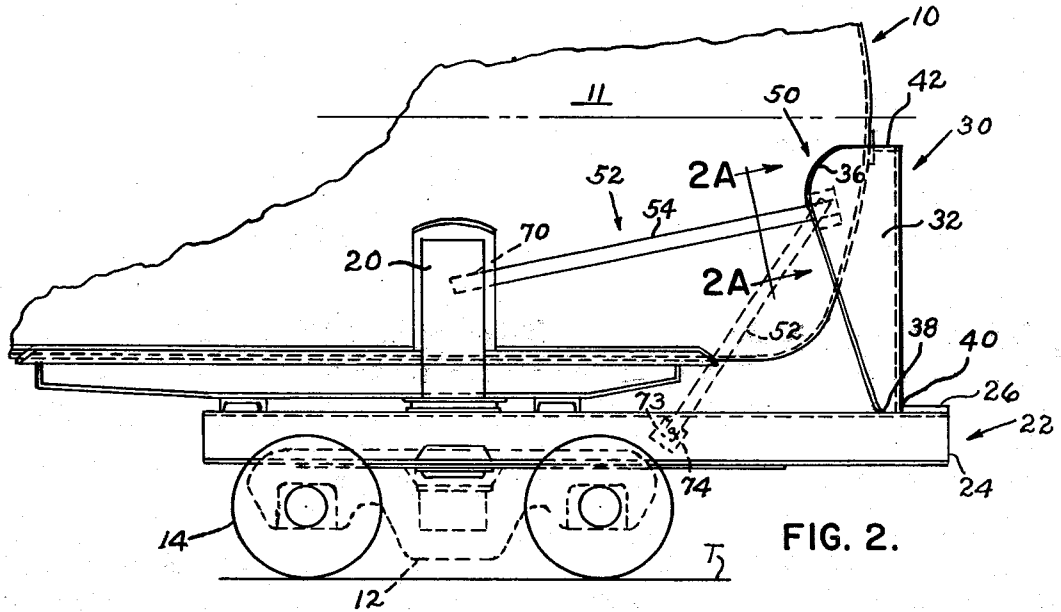
FIG. 2 is a side elevational view of the support assembly of the present invention.
Figure 6:
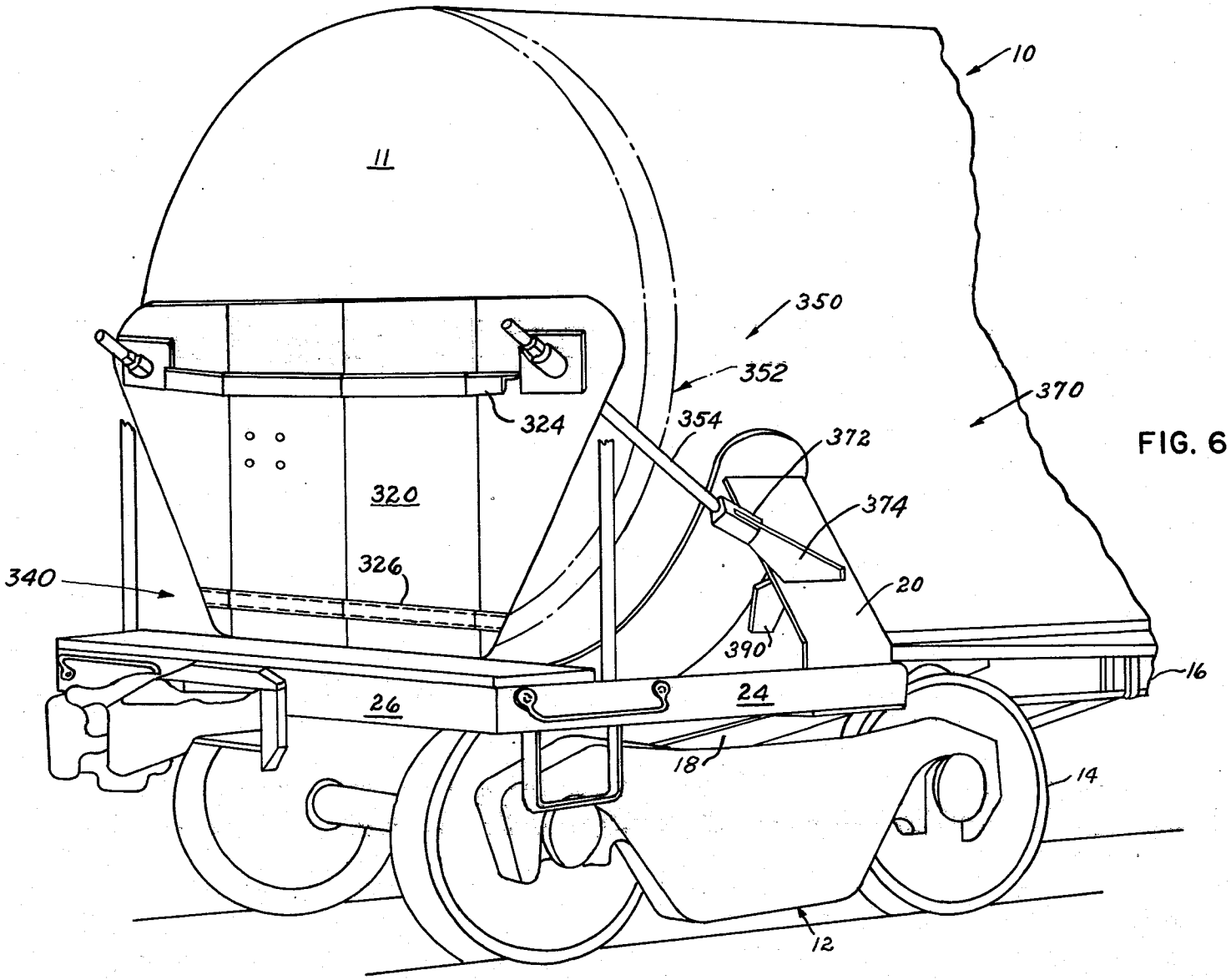
FIG. 6 is a perspective end view of a tank car and head shield support assembly according to another embodiment of the present invention.

In accordance with the embodiment shown in FIGS. 1–3 of the drawings, a railway tank car is indicated generally at 10. The tank car 10 is of conventional construction having a truck 12 which has wheels 14 which support the truck for movement on a railway track T. The tank car further comprises a center sill 16, which may be a through sill or a stub sill, having a body bolster 18 integrally affixed thereto, for example, by welding. Body bolster 18 preferably comprises bolster caps 20 which support the tank body. The tank car further comprises a tank car end sections indicated generally at 22 comprising a longitudinal end sill 24 and a transverse end sill portion 26 longitudinal end sill portions 24.

The head shield assembly of the present invention is indicated generally at 30. A tank car head shield is indicated at 32. Head shield 32 preferably comprises a formed plate adapted to generally conform to the end contour of the tank as indicated in FIG. 3. Thus the head shield is formed with an inward contour or curve 34 to conform generally to the contour of the tank. The head also preferably has sufficient transverse extent to extend to near the side of the tank. The head shield further preferably extends upwardly to at least 4feet-6inches minimum from the sill and preferably to near half the height of the tank or even higher. Openings 33 may be provided for attachment of a railway hand brake. Thus when a coupler from adjacent car should bypass and move upwardly into the area of the tank, the shield will prevent the coupler from puncturing the tank. If desired, the head shield may be cut as indicated at 36, to save weight.

The shield further comprises means indicated generally at 38 to connect the head shield to the center or stub sill portion 16. This may comprise, for example, a plate 40 welded or integrally affixed with mechanical fasteners to stub sill portion 16. In the case of through center sill cars, the shield is connected to the center sill.

Shield 32 may further comprise a bearing pad 42. Bearing pad 42 may comprise an angle or a T member integrally affixed to head shield 32, preferably by welding, and is provided for the purpose of mechanically engaging the tank 11. Bearing pad 42 cannot be welded to the tank body because, as mentioned above, the welding heat affected zone could affect the tank body. In accordance with the tank car pressure vessel code, another member cannot be welded to the tank car body unless the tank is subsequently given an anneal or other appropriate heat treatment. Therefore only a mechanical connection can be made between pad 42 and the tank body.

Thus means must be supplied to support the head shield in the vertical position shown in the drawings. Head shield support means are shown in the drawings generally at 50. The support means comprise support members 52. These support members may comprise metal plates or straps as shown in the drawings at 54 in FIGS. 1–3 or they may comprise a bar as shown at 154 in FIG. 4, rods as shown in FIGS. 5–8. Alternatively, chains or cables may be utilized as well as pipes or tubing.

Support means 50 further comprises head shield connecting means for affixing the support members 52 to the tank car head shield on opposite ends thereof. Thus head shield connecting means is shown in FIG. 2A generally at 60. In accordance with this embodiment the head shield connecting means 60 comprises at least one and preferably a pair of plates 62 and 64, integrally affixed, for example, be welding to opposite ends of head shield 32 in the upper portion thereof. During assembly, straps 54 are placed adjacent and/or between the plates 62 and/or 64 then suitable fasteners, such as a nut and bolt 66 and 67, are used to hold the same in place. Alternatively, straps 54 may be welded to plates 62 and/or 64.

Support members 52 must be connected to suitable support portion of the car. Supports 52, for example, may be connected to longitudinal end sill portions 24. As shown dotted in FIG. 2 support members 52 may be connected to longitudinal end sill portion 24 with fasteners 74 and a suitable fastening plate 73, or supports 52 may be welded directly to end sill portion 24. However, this makes quite a steep angle and thus less effective support is achieved in this fashion. Therefore, preferably the support member 52 is connected to the bolster cap 20. Means for connecting the support members 52 to the tank car support is indicated in the drawings generally at 70. In accordance with the embodiment shown in FIG. 2, support members 52 are welded to the bolster cap as shown at 72. It will be obvious to those skilled in the art that appropriate mechanical fasteners may also be utilized.

Figure 4:
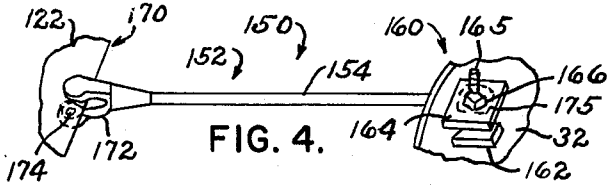
FIG. 4 is a view of another embodiment of the support assembly illustrating other embodiments of connections between the support and the head shield and between the support and a plate integral with the bolster cap.

FIG. 4 shows an alternative head shield support means 150. In this embodiment the support members 152 comprise rods 154 instead of straps 54 as shown in FIG. 2. Head shield fastening means 160 are along the same lines as shown in FIGS. 1–3. Plates 175 are welded onto rods 154 and during assembly these plates are integrally affixed to one or more plates 162 and/or 164 and fasteners 165 and 166 are utilized to hold supports 152 in place on the head shield.

However, the support connecting means 170 preferably comprise a clevis 172 which is connected by means of a pin 174 to bolster cap 20 or preferably to a plate 122 which is welded to bolster cap 20.

The embodiment in FIG. 4 has some advantages over the embodiment shown in FIGS. 1–3. In the head shield connecting means 160 the fasteners 165 and 166 are on the outboard side of the head shield rather than on the inside. Thus the likelihood of puncture of the tank in the event that the head shield is smashed against the tank body in impact and/or in the event of derailment is reduced. Secondly, the use of the clevis 172 provides flexibility allowing disassembly of the head shield arrangement, if desired.

Figure 5:
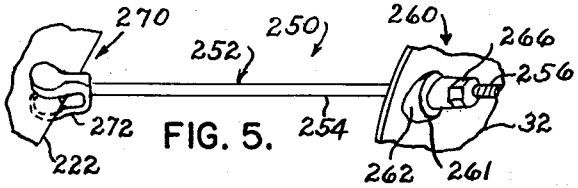
FIG. 5 illustrates another arrangement for connecting the support member to the head shield.

Another embodiment of the present invention is shown in FIG. 5 in which the head shield support means 250 comprises a head shield support members 252 which comprise rods 254. Rods 254 are connected to a plate 222 integral with the bolster cap with support connecting means 270 comprising a clevis 272 similar to FIG. 4. However, the head shield connecting means 260 comprise collars 262 through which rod 254 passes. Thus in order to assemble support means 270, rods 254 are first connected to the bolster cap plates 222 by means of clevises 272. Then rod 254 is passed through openings 261 in head shield 32 and through collars 262. Rods 254 are threaded as indicated at 256 and nut fasteners 266 are utilized to hold the rod in place. If desired, nuts 266 may be welded to rods 256 to avoid the nuts vibrating off, and to reduce pilferage.

Again this embodiment has the advantage that the fasteners 256 and 266 are on the outboard side and point outwardly and away from the tank body, and are thus much less likely to puncture the adjacent tank.

Also, this arrangement is readily aligned and assembled. Furthermore, rods 254 may be threaded at 256 for a variety of sizes of tank cars. The rods may be cut off to a greater or lesser extent depending on the tank size.

Figure 8:
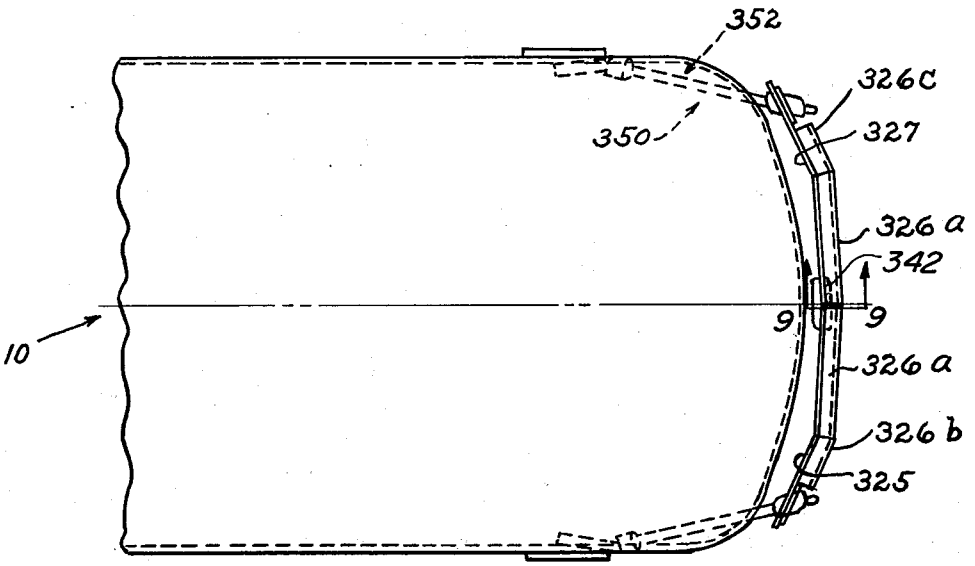
FIG. 8 is a plan view of the support assembly shown in FIGS. 6 and 7.
Figure 7:
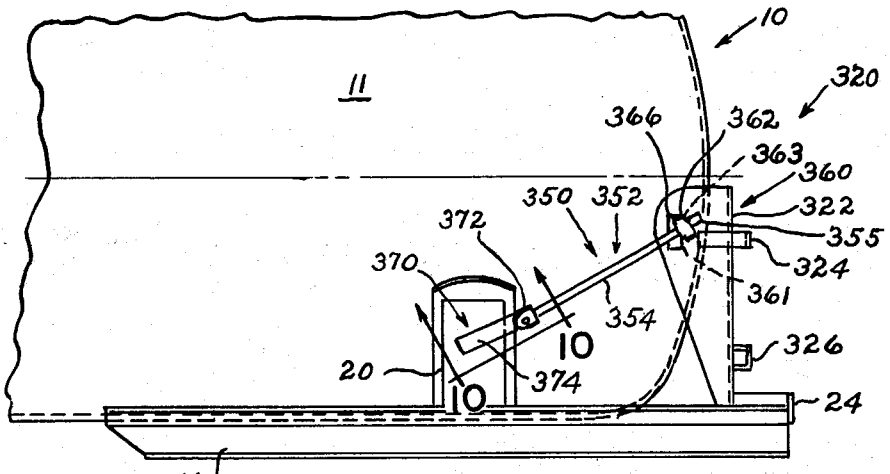
FIG. 7 is a side elevational view of the support assembly shown in FIG. 6.

Still another embodiment of the present invention is shown in FIGS. 6–10. In this embodiment the tank car indicated generally at 10 comprises a tank body 11. In this embodiment head shield 320 is not provided with the bearing pad shown in FIGS. 1–3. However, in order to provide for rigidity of the head shield, a reinforcing member 324, for example, an angle is provided in the upper portion of the head shield and, if desired a second reinforcing member, such as a channel section 326, may be provided in the lower portion. Connection means 340 again comprises a plate 342 which is welded or otherwise appropriately affixed to head shield plate 320 and the center or stub sill member 24. As shown in FIG. 8, plate 322 is contoured at 325 and 327 to generally conform to the contour of the tank 11. Reinforcing members 324 and/or 326 may be assembled from three members 326A, 326B and 326C and welded together as shown in FIG. 8.

Head shield support means 350, according to this embodiment, comprise a support members 352 which are preferably rods, as shown at 354. Head shield connecting means 360 preferably comprises openings 361 in head shield 322 through which rod 354 passes. Reinforcing plates 362 are preferably integrally affixed preferably by welding to head shield 322. Plates 362 respectively have openings therein 363 through which rods 354 pass. Fastening nuts 366 are again utilized in engagement with threaded portion 355 to hold the rods in place. If desired, nuts 366 may be welded to threaded portion 355.

Figure 10:
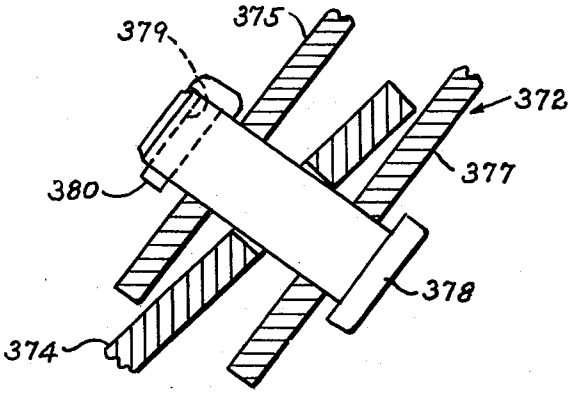
FIG. 10 is a sectional wall along the lines 10—10 in FIG. 7.
Figure 9:
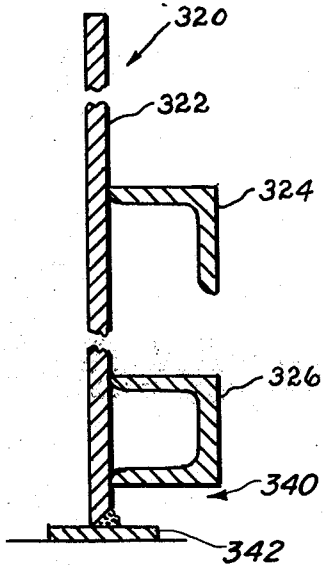
FIG. 9 is a sectional view along the lines 9—9 in FIG. 6.
Figure 15:
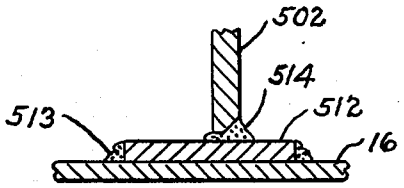
FIG. 15 is a vertical view along the lines 15—15 in FIG. 11.
Figure 11:
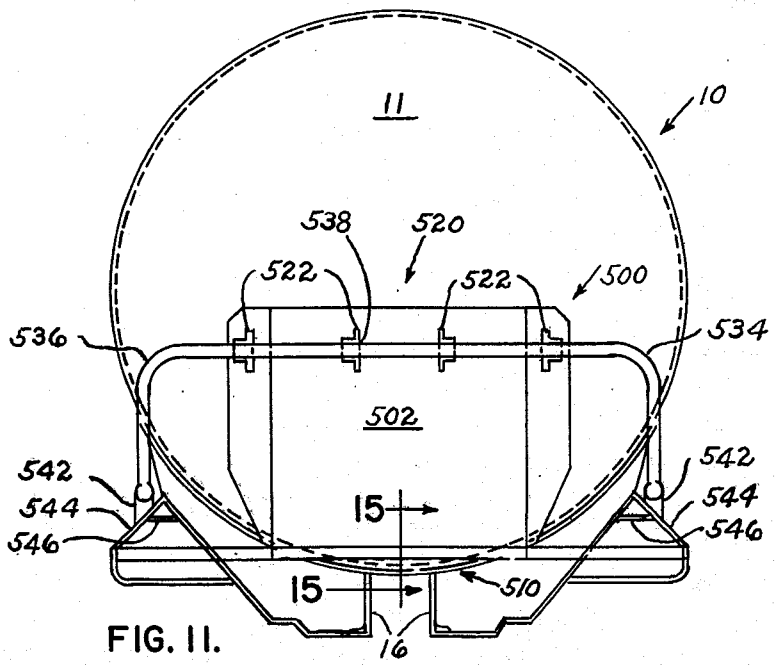
FIG. 11 is an end view of another embodiment of the present invention.
Figure 14:
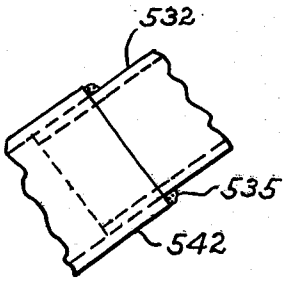
FIG. 14 is an enlarged view along the line 14 in FIG. 13.

Support connecting means 370 preferably comprises a clevis 372 which as shown in FIG. 10 comprises spaced plates 375 and 377. A plate 374 is integrally affixed, preferably by welding, to bolster cap 20. A headed pin 378 then passes through plates 374, 375, and 377. Pin 378 is provided with an opening 379 to receive a cotter pin 380.

During assembly, rods 354 are first affixed to plates 374 on opposite sides of the car by means of clevis 372. Then rods 354 are passed through openings 361 and 363, respectively on opposite ends of head shield 322 and in reinforcing plates 366. Nuts 366 are applied and welded to threads 355, if desired.

This embodiment has the advantage that the head shield bearing pad 42 need not be provided. Thus under very severe impact the pad could not in any way puncture the tank. Under impact, the rods 354 bend and the head shield 322 will contact the tank.

The use of the clevises 372 and the threaded rods 354 makes assembly of the head shield support assembly simpler and alignment problems are reduced.

If desired one or more gussets 390 may be provided to reinforce the bolster cap 20 to avoid the later buckling under impact.

Another embodiment of the present invention is shown in FIGS. 11–15. In this embodiment the tank car head shield assembly is indicated in the drawings generally at 500. This embodiment is particularly adaptable to smaller head shields which do not have the large ears whicnh are found in the head shields of the previous embodiments. It will be apparent from FIG. 11 that the head shield in this embodiment is reduced insofar as its transvers extent is concerned. It will be apparent from FIG. 13 that the head shield 502 is bent inwardly toward the car at 504 and 506. This head shield weighs considerably less than the larger head shields of the previous embodiments. The head shields of the previous embodiments weigh in the area of 600 pounds or more, while the head shield of the embodiment shown in FIGS. 11–13 weigh in the area of 500 pounds. Thus, a considerable weight saving can be achieved with the use of this head shield. While it does not cover as much of the transverse face of the tank, data indicates that punctures to the tank have always occurred in the area which the head shield in this embodiment covers. Thus, the data indicates that this shield will provide an equal amount of protection as the head shield of the previous embodiments.

The head shield is affixed to the center sill by fastening means indicated generally at 510. This may comprise a plate 512 which is welded to the center sill 16 as indicated at 513 and to which the head shield 502 is welded as indicated at 514. It will be apparent that the head shield may also be affixed to the center sill with mechanical fasteners.

Means are provided for affixing support means to the upper portion of the head shield on the outboard side. This means is indicated generally at 520. In this embodiment the head shield engagement means comprises a series of brackets 522.

Means for the supporting the head shield is indicated in the drawing generally at 530. In this embodiment the support means may comprise a pipe or tube 532. Preferably a pipe is utilized having a diameter of 1 to 4 inches because, in general, pipe is less expensive than tubing. In accordance with one embodiment the pipe 532 may be one single member with two 90° bends on opposite sides of the shield 534 and 536. The pipe is welded to the brackets as indicated at 538. Alternatively, two pipes may be utilized each having a 90 degree bend cover or the bolster cap.

A further advantage of the use of a pipe 532 is it performs the function of stiffener as well as a support member.

Figure 13:
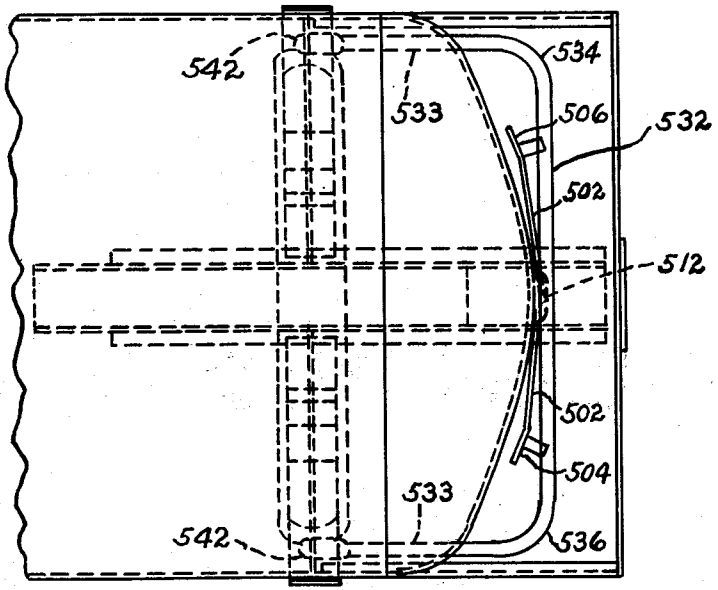
FIG. 13 is a plan view of the embodiment shown in FIGS. 11 and 12.
Figure 12:
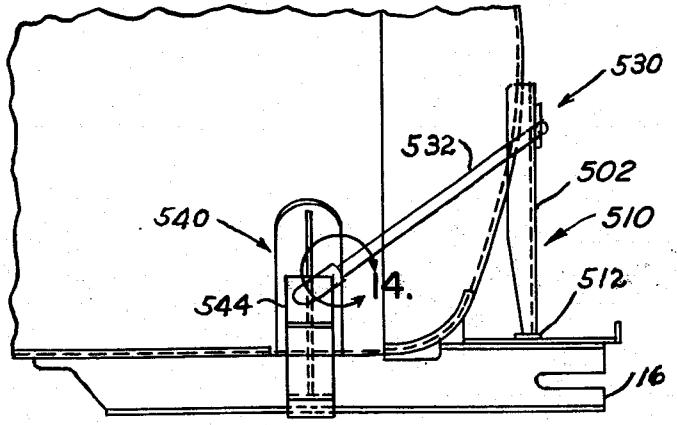
FIG. 12 is a partial side elevation view of the embodiment shown in FIG. 11.

It will be apparent from FIG. 13 that pipe 532 at its inner end portion 533 passes under the transverse extent of the tank 10.

What is claimed is:

1. A tank car head shield assembly comprising: a tank car head shield adapted to extend transversely across and vertically upwardly from the end portion of a railway tank car, said head shield covering a substantial portion of the lower part of the tank car end, said tank car head shield having means for connecting the head shield to the center sill or end sill of a railway tank car; a pair of tank car head shield support members extending longitudinally inwardly from said head shield on opposite sides of said car; head shield connecting means connecting said support members to said head shield located on the outboard side of said shield; and support connecting means for affixing said tank car head shield support members to tank car support structure on opposite sides of the car spaced longitudinally inwardly from said tank car end portion.

2. A tank car head shield assembly according to claim 1 wherein said support connecting means are affixed to longitudinal end sill portions of the car.

3. A tank car head shield assembly according to claim 7 wherein said support connecting means are affixed to bolster caps on said car.

4. A tank car head shield assembly according to claim 3 wherein the bolster cap is provided with bolster reinforcement.

5. A tank car head shield assembly according to claim 4 wherein said bolster reinforcement comprises at least one gusset.

6. A tank car head shield assembly according to claim 1 wherein the means for affixing said head shield to said sill comprises a weld.

7. A tank car head shield assembly according to claim 1 wherein the means for affixing said head shield to said sill comprises mechanical fasteners.

8. A tank car head shield assembly according to claim 1 wherein said tank car head shield comprises a bearing pad.

9. A tank car head shield assembly according to claim 8 wherein said bearing pad comprises a T-shaped member.

10. A tank car head shield assembly according to claim 8 wherein said bearing pad comprises an angle.

11. A tank car head shield assembly according to claim 1 wherein said tank car head shield comprises at least one reinforcing member extending transversely across said head shield.

12. A tank car head shield assembly according to claim 11 wherein more than one reinforcing member is provided on said tank car head shield.

13. A tank car head shield assembly according to claim 11 wherein said reinforcing member comprises an angle.

14. A tank car head shield assembly comprising: a tank car head shield adapted to extend tranversely across and vertically upwardly from the end portion of a railway tank car, said head shield covering a substantial portion of the lower part of the tank car end, said tank car head shield having means for connecting the head shield to the center sill or end sill of a railway tank car; a pair of tank car head shield support members extending longitudianlly inwardly from head shield, on opposite sides of said car; openings on opposite sides of said head shield through which said support members pass; head shield connceting means located outboard of said head shield for affixing said support members to said head shield; and support connecting means for connecting said tank car head shield support members to tank car support structure on opposie sides of the car spaced longitudinally inwardly from said tank car end portion.

15. A tank car head shield assembly according to claim 14 wherein said support members comprise straps.

16. A tank car head shield assembly according to claim 14 wherein the support connecting means comprise mechanical fasteners.

17. A tank car head shield assembly according to claim 16 wherein the mechanical fasteners comprise a clevis.

18. A tank car head assembly according to claim 14 wherein said head shield connecting at least one support plate connected to each support member outboard of said shield and a pair of head shield plates mounted on the outboard side of said head shield and at least one fastener respectively connecting each said support plate and each said head shield plate.

19. A tank car head shield assembly according to claim 14 wherein said support members comprise bars and wherein said head shield connecting means comprise a pair of head shield plates mounted on the outboard side of said head shield, and wherein said bars are respectively held in place by at least one pin which passes through one of said bars and one of said head shield plates on the outboard side of said head shield.

20. A tank car head shield assembly according to claim 14 wherein said support members comprise rods passing through the head shield openings and wherein said rods are threaded on the ends of said rods outboard of said head shield to receive threaded fasteners.

21. A tank car head shield assembly according to claim 20 wherein nuts engage the threaded portion of said rods to hold the same in place on said head shield.

22. A tank car head shield assembly according to claim 21 wherein said nuts are welded to the threaded portion of said rods.

23. A tank car head shield assembly according to claim 21 wherein collars are provided on said tank car head shield and wherein said nuts engage said collars.

24. A tank car head shield assembly comprising: a tank car head shield adapted to be mounted on the end of a railway tank car, said head shield extending tranversely across and vertically upwardly throughout a substantial portion of the vertical extent of the tank car and throughout less than the entire transverse extent of a tank mounted on the car; means for affixing the lower portion of said head shield to a center sill or stub still portion of said tank car; a head shield support extending from the upper ends of said shield longitudinally inwardly, means for affixing said head shield support to said tank car head shield on the outboard side of said shield; said support having bends on opposite ends of said shield whereby said support extends longitudinally inwardly on opposite sides of the car; and means for affixing said head shield support to tank car support structure located longitudinally inwardly from said head shield on opposite sides of the car.

25. A tank car head shield support assembly according to claim 24 wherein said support comprises a single support having bends on each end of said head shield.

26. A tank car shield support assembly according to claim 24 wherein said support comprises a pair of supports each having a bend on one end of said shield.

27. A tank car head shield assembly according to claim 24 wherein said head shield support comprises pipe.

28. A tank car head shield assembly according to claim 27 wherein the means for affixing the pipe to the structure located inwardly from the head shield comprises a pipe of larger diameter than said pipe affixed to said head shield.

29. A tank car head shield assembly according to claim 24 wherein said head shield support member comprises tubing.

30. A tank car head shield assembly according to claim 29 wherein the means for affixing the tubing to the structure located inwardly from the head shield comprises tubing of larger diameter than said tubing affixed to said head shield.

* * * * *

UNITED STATES PATENT OFFICE

CERTIFICATE OF CORRECTION

PATENT NO. : 3,994,239

DATED : November 30, 1976

INVENTOR(S) : Forrest L. Baker, et. al.

It is certified that error appears in the above-identified patent and that said Letters Patent are hereby corrected as shown below:

Column 2, lines 46 - 68, should be deleted.
Column 4, line 3, "be" should read -- by --.

Signed and Sealed this

Fifteenth Day of March 1977

[SEAL]

*Attest:*

RUTH C. MASON
*Attesting Officer*

C. MARSHALL DANN
*Commissioner of Patents and Trademarks*

UNITED STATES PATENT AND TRADEMARK OFFICE

Certificate

Patent No. 3,994,239 Patented November 30, 1976

Forrest L. Baker, Joseph F. Niggemeier and Dallas W. Rolling

Application having been made by Forrest L. Baker, Joseph F. Niggemeier and Dallas W. Rolling, the inventors named in the patent above identified, and ACF Industries, Incorporated, a corporation of New Jersey, the assignee, for the issuance of a certificate under the provisions of Title 35, Section 256, of the United States Code, adding the name of Donald E. Gruner as a joint inventor, and a showing and proof of facts satisfying the requirements of the said section having been submitted, it is this 13th day of September 1977, certified that the name of the said Donald E. Gruner is hereby added to the said patent as a joint inventor with the said Forrest L. Baker, Joseph F. Niggemeier and Dallas W. Rolling.

FRED W. SHERLING,
*Associate Solicitor.*